US007074135B2

(12) United States Patent
Moore

(10) Patent No.: US 7,074,135 B2
(45) Date of Patent: Jul. 11, 2006

(54) ADJUSTABLE LENGTH GOLF PUTTER WITH SELF LOCKING DESIGN

(76) Inventor: Simon Garry Moore, 18 Bronte Place, Cambridge 2351 (NZ)

( * ) Notice: Subject to any disclaimer, the term of this patent is extended or adjusted under 35 U.S.C. 154(b) by 0 days.

(21) Appl. No.: 10/484,126

(22) PCT Filed: Jul. 15, 2002

(86) PCT No.: PCT/NZ02/00123

§ 371 (c)(1),
(2), (4) Date: May 14, 2004

(87) PCT Pub. No.: WO03/008048

PCT Pub. Date: Jan. 30, 2003

(65) Prior Publication Data

US 2004/0198529 A1 Oct. 7, 2004

(30) Foreign Application Priority Data

Jul. 18, 2001 (NZ) ..... Z512998

(51) Int. Cl.
*A63B 53/16* (2006.01)

(52) U.S. Cl. ..... 473/296; 403/290; 403/344

(58) Field of Classification Search ..... 473/294, 473/296, 298–299, 288; 279/43.5, 43.3, 279/43.2, 46.3, 2.02, 4.07; 403/338, 373, 403/290

See application file for complete search history.

(56) References Cited

U.S. PATENT DOCUMENTS

| | | | | |
|---|---|---|---|---|
| 3,473,202 | A * | 10/1969 | Howard | 403/344 |
| 3,539,185 | A * | 11/1970 | Andis | 473/296 |
| 4,974,846 | A * | 12/1990 | Fenton | 473/303 |
| 5,096,327 | A * | 3/1992 | Ruland | 403/290 |
| 6,413,006 | B1 * | 7/2002 | Neugart | 403/344 |
| 6,488,595 | B1 * | 12/2002 | Grace | 473/341 |

FOREIGN PATENT DOCUMENTS

| | | | |
|---|---|---|---|
| GB | 2309389 | * | 7/1997 |

* cited by examiner

*Primary Examiner*—Stephen Blau
(74) *Attorney, Agent, or Firm*—Greer, Burns, & Crain, Ltd.

(57) ABSTRACT

An adjustable length golf putter, including at least one shaft, at least one grip attached to the at least one shaft, a self-locking mechanism associated with the putter for lengthwise adjustment of the at least one shaft relative to the at least one grip, the mechanism configured for accommodating an adjustment tool, and being locked by default so that the tool must be engaged in the mechanism for the lengthwise adjustment.

16 Claims, 7 Drawing Sheets

ADJUSTABLE LENGTH GOLF PUTTER WITH SELF LOCKING DESIGN

CROSS REFERENCE TO RELATED APPLICATIONS

Moore, U.S. Pat. No. 6,213,891

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

Golf has become a popular recreational game. In the game of golf a ball is played from the teeing ground to the putting green by successive strokes, and once on the putting green into the hole, using a specialised club called a putter.

A conventional short putter (FIG. 1) is between 85 and 90 cm. in total length, and has a single grip 1, located at a top end of a shaft 2, and a putter head 3 located at a bottom end of the shaft. The player grasps the single grip with both hands (FIG. 2) when putting the ball with the putter head 3.

Whilst the use of a putter is an apparently simple action, it is perhaps the part of golf which is least reliable from day to day. A common problem that golfers experience when putting is excessive wrist flexure, or hinging of the wrists, when swinging their putter, which contributes to inconsistency of both direction and distance control.

An extreme form of poor putting is a condition known as the "yips", whereby the golfer has greatly excessive wrist flexure in his/her stroke, sometimes accompanied by excessive body movement as well. It has been known for golfers suffering from the putting "yips" to occasionally even miss the ball completely.

Many famous golfers, including Sam Snead, Ben Hogan, Bernhard Langer, and Tom Watson have had periods of very unreliable short distance putting, using conventional short putters.

To improve their putting some golfers are no longer using a conventional short putter, and are now using a long putter (FIG. 3) in a simple pendulum type putting action, or a belly putter, which is a mid-length putter which hinges from the belly button.

As such there are now three distinct types of putter: short, mid. (or belly), and long.

A long putter is between 120 and 130 cm. in total length, and has two grips, an upper grip 4, located at a top end of a first shaft 5, and a lower grip 6, below it on the shaft. The player grasps the upper grip 4 with one hand when putting the ball, and this upper hand is stabilised against the body, usually the chest (FIG. 4), or chin, and remains relatively stationary during the putting stroke. The other hand grips the lower grip 6, providing the force to hit the ball, and the putter is pivoted with this lower hand from a pivot point in the approximate area of the upper hand.

The long putter is sometimes difficult to transport as it is too long for many car trunks. Therefore it would be an advantage if a long putter was adjustable for length so the golfer could alter the length to shorten the putter for ease of transportation.

Also when using the long putter, (FIG. 4), the golfer draws attention to the use of this putter, as one elbow 7, sticks out. This ungainly looking method can cause the golfer embarrassment.

Putters may have the single short grip 1 (FIGS. 1 and 2), the pair of short grips 4, 6 (FIG. 3), or a single long grip 8, with various tapers (FIGS. 5 and 6), or no taper (FIG. 7).

In late 1999 a well known professional golfer called Paul Azinger began using a mid length putter which is long enough to fit into his belly button when assuming the normal putting posture. A belly putter has one or two grips. This method has become known as belly putting, and in the last two years has grown in popularity with four golfers in the top fifty of the world rankings now using a belly putter.

Belly putters are commercially available in various fixed lengths from 100 to 115 cm.

There is a link to companies selling belly putters on the web site http://www.bellyputter.com.

It would also be an advantage if a belly putter was adjustable for length, so the golfer could alter the length to suit their desired posture, and that this adjustment was conforming to the Rules of Golf, as determined by the United States Golf Association™, and the Royal and Ancient Golf Club of St Andrews™.

In 2000, Dave Pelz, a well respected golf instructor; and coach to many world ranking professionals, published a golf instructional book called "The Short Game Bible" (Broadway Books, New York, 2000). Mr Pelz noted that to avoid adopting a weak and unstable wrist position at the address position it is advisable to use a shorter putter than is currently available.

Short putters are commercially available only in various fixed lengths from 80 to 90 cm.

Therefore it would also be an advantage if a short putter was adjustable for length so the golfer could alter the length to suit their desired posture.

Telescoping golf shafts are described in patents, and the following patents represent the approaches to securing the shafts.

Middleton, U.S. Pat. No. 5,733,203, describes a telescoping putter, with two shafts, with a "locking screw" to secure the shaft.

Harrison, U.S. Pat. No. 5,649,870, describes a telescopic shaft arrangement where simple friction secures the two telescoping tapered shafts in a semi fixed position.

Mazzocco, U.S. Pat. No. 4,674,747 discloses a golf club having adjustable length shaft retractable between fully extended and collapsed positions. The golf club has plural concentric telescopic interlocking tubular sections which produce a friction lock between the tubular sections in a fully extended position There is a club commercially available utilizing this principle (http:/www.allinonegolfclub-.com).

Sundin, U.S. Pat. No. 5,584,769, describes a shaft which can be constructed of two or more telescopically-adjustable or collapsible members to allow the same to adjust to different lengths for individual golfers. However, Sundin does not specify how the two shafts are to be secured in position.

Lee, U.S. Pat. No. 5,569,096, describes "the shaft inserted into the handle, threadably tightening a locking nut over a flexible ring and a external thread until the flexible ring is squeezed over the shaft prevents the shaft from slipping—thereby effectively locking the shaft in the desired length."

Napolitano, U.S. Pat. No. 5,282,619, describes a shaft which has a number of telescopic sections where a locking nut and a compression ring permit adjacent sections of the telescopic section to be locked in a fixed position relative to each.

Whilst all the above patented inventions technically allow adjustment none are both variable in length and in accordance with the Rules of Golf.

The Rules of Golf do not allow readily made adjustment to clubs, and until May 2002 an adjustable length putter has never been determined as legal by the United States Golf Association.

18 pars Ltd, a company in which the applicant is a shareholder, is in receipt of a letter from the United States Golf Association™, which states "the default-locked mechanism submitted has been judged conforming with the Rules of Golf." (letter from the United States Golf Association, April 2002, Decision 2002-185).

This is the first time ever that a length adjustable putter has been approved. The United States Golf Association™ has decided the default locked mechanism submitted can not be inadvertently, or secretly adjusted by the golfer during the play of a round of golf.

A mechanism which is conforming for belly putters is also likely to be judged conforming for regular shorter putters. Whilst not as critical as for belly putters, it is nevertheless advantageous to be able to customise the length for all types of putters, to suit the golfer's physique, and preferred posture when putting.

BRIEF SUMMARY OF THE INVENTION

A putter, adjustable in length to suit the golfer's stature and preferred posture, which, utilises a self locking fixing mechanism to secure the putter, tat necessitates a tool to adjust the length of the putter. Without the tool the putter length is fixed.

A self locking fixing mechanism is defined as a mechanism which, by default, locks or fixes the components of the putter relative to each other, and is secure enough so that it requires a tool to loosen the components, and thereby adjust the length of the putter.

In the detailed description and drawings that follow three self locking mechanism are described by way of example. These are a self locking collet, a self locking split tube, and a self locking threaded fitting with frictional internal ribs.

BRIEF DESCRIPTION OF SEVERAL VIEWS OF THE INVENTION

Figure 9A:
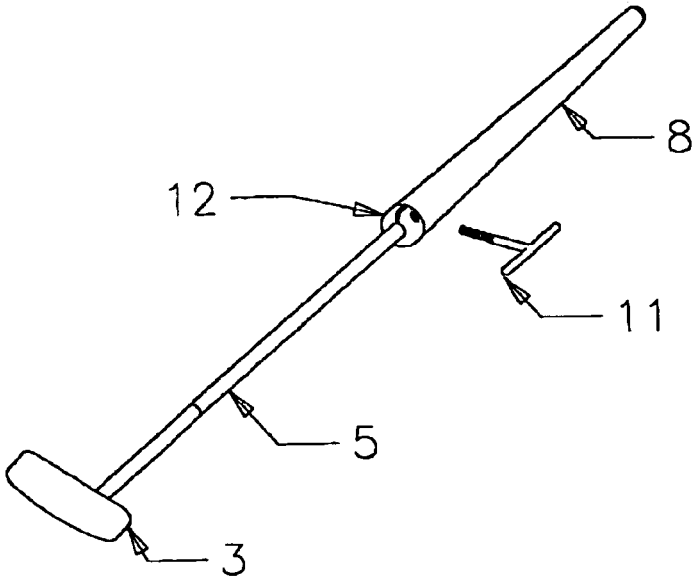

FIG. 9*a* is an adjustable length putter with a single grip.

Figure 9C:
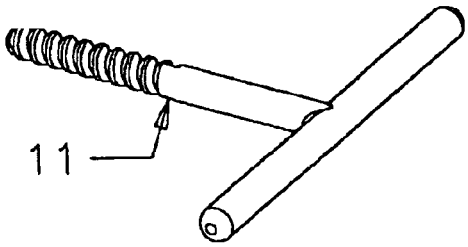
Figure 9B:
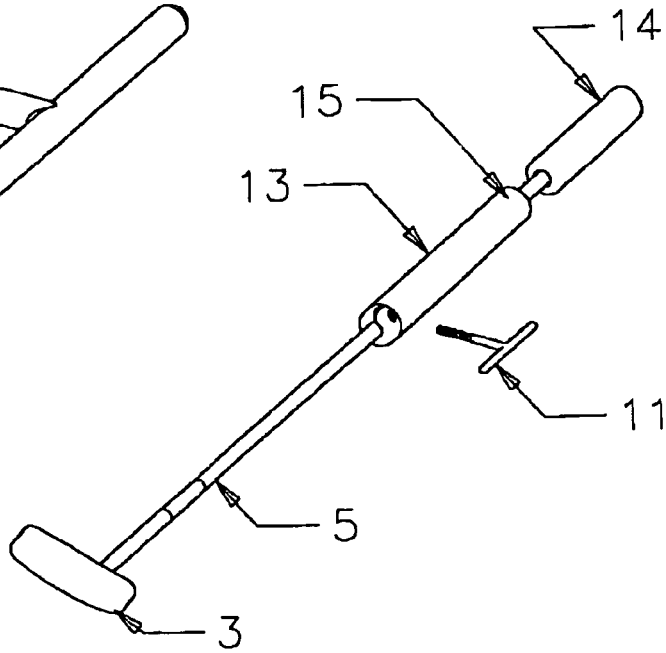

FIG. 9*b* is an adjustable length putter with two grips.

FIG. 9*c* is a threaded adjusting tool.

Figure 10:
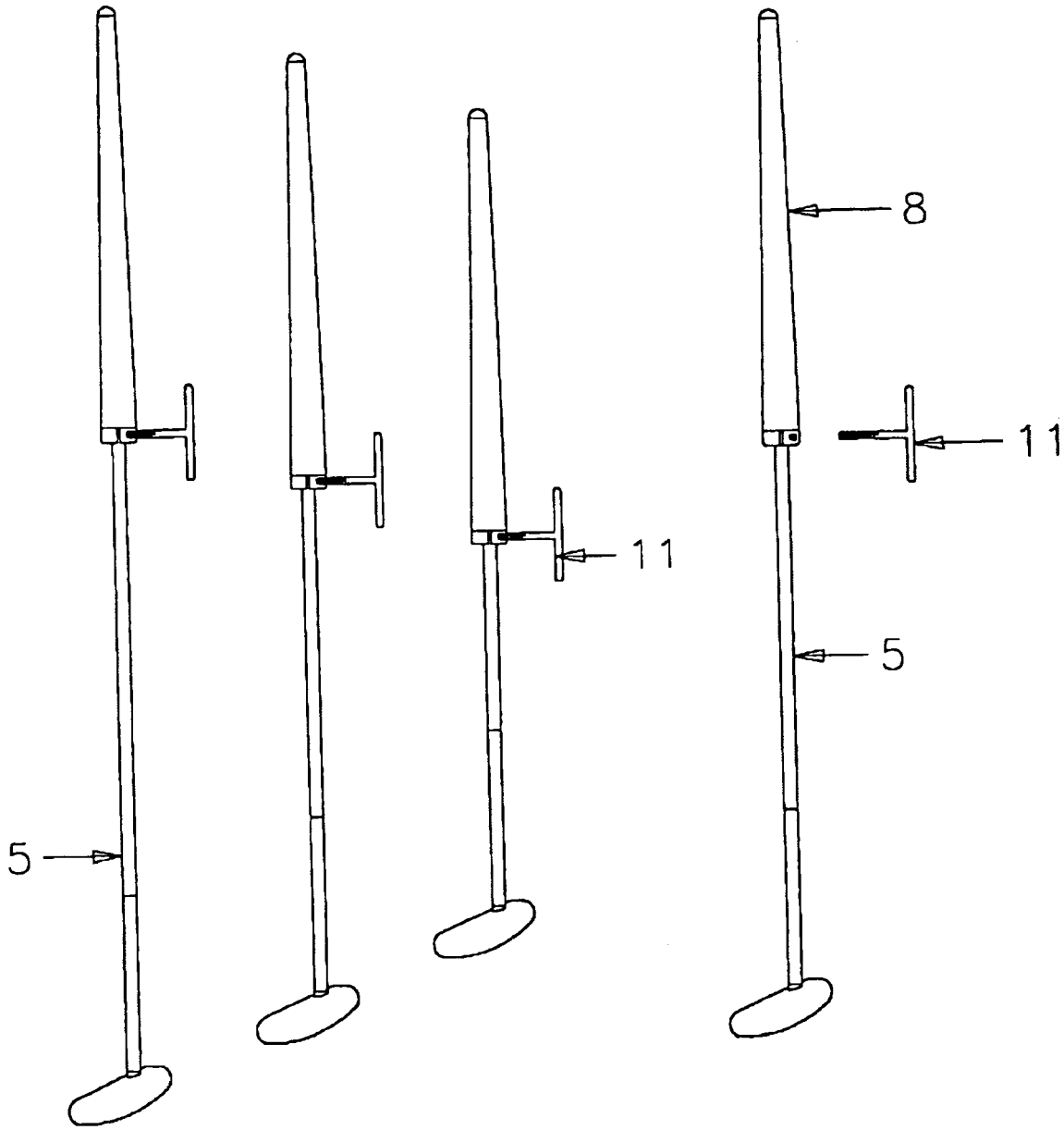

FIG. 10 shows a telescoping putter in various lengths, and with the adjusting tool removed.

Figure 11:
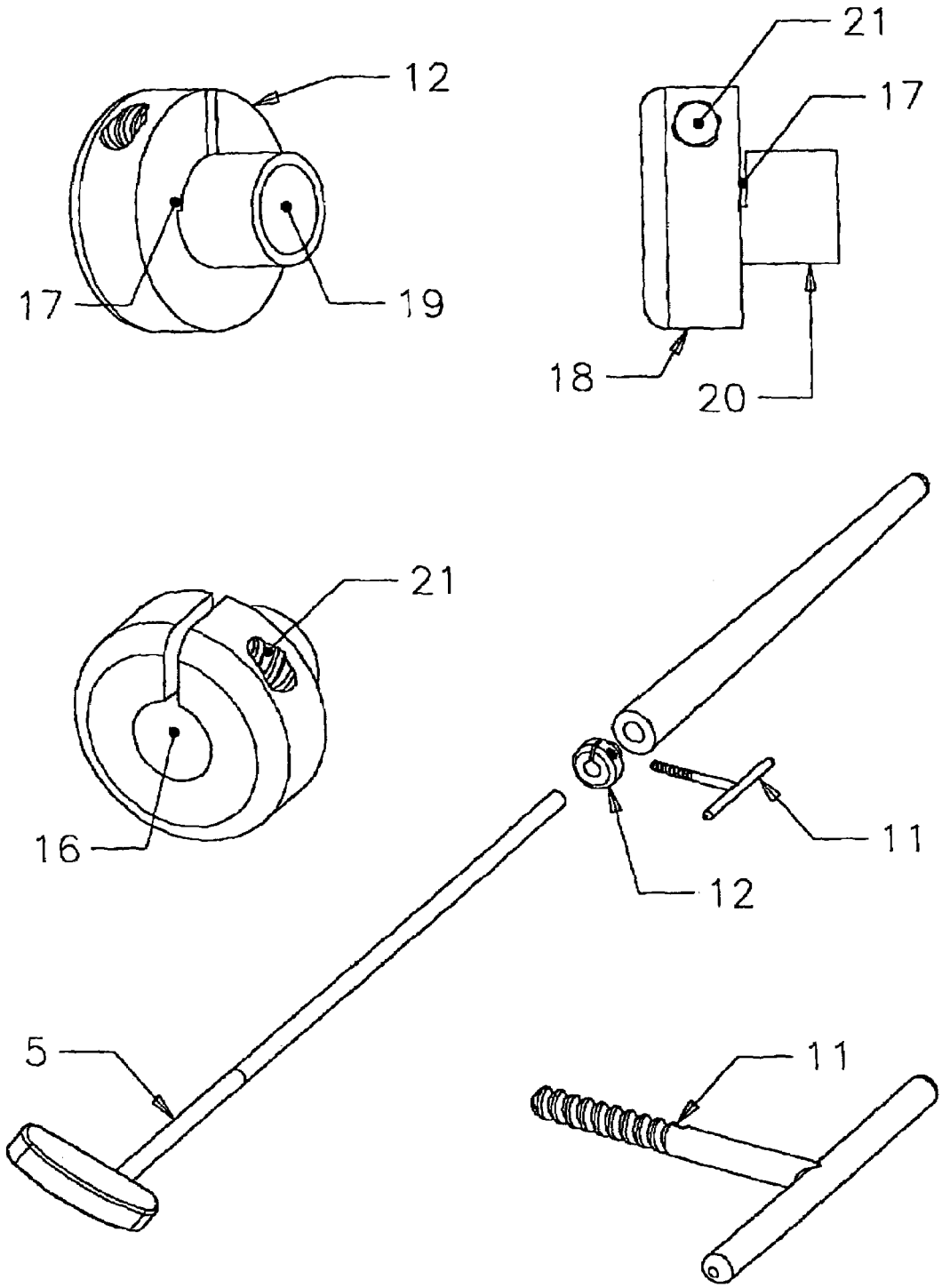

FIG. 11 is a self locking collet mechanism, with adjusting tool.

Figure 12:
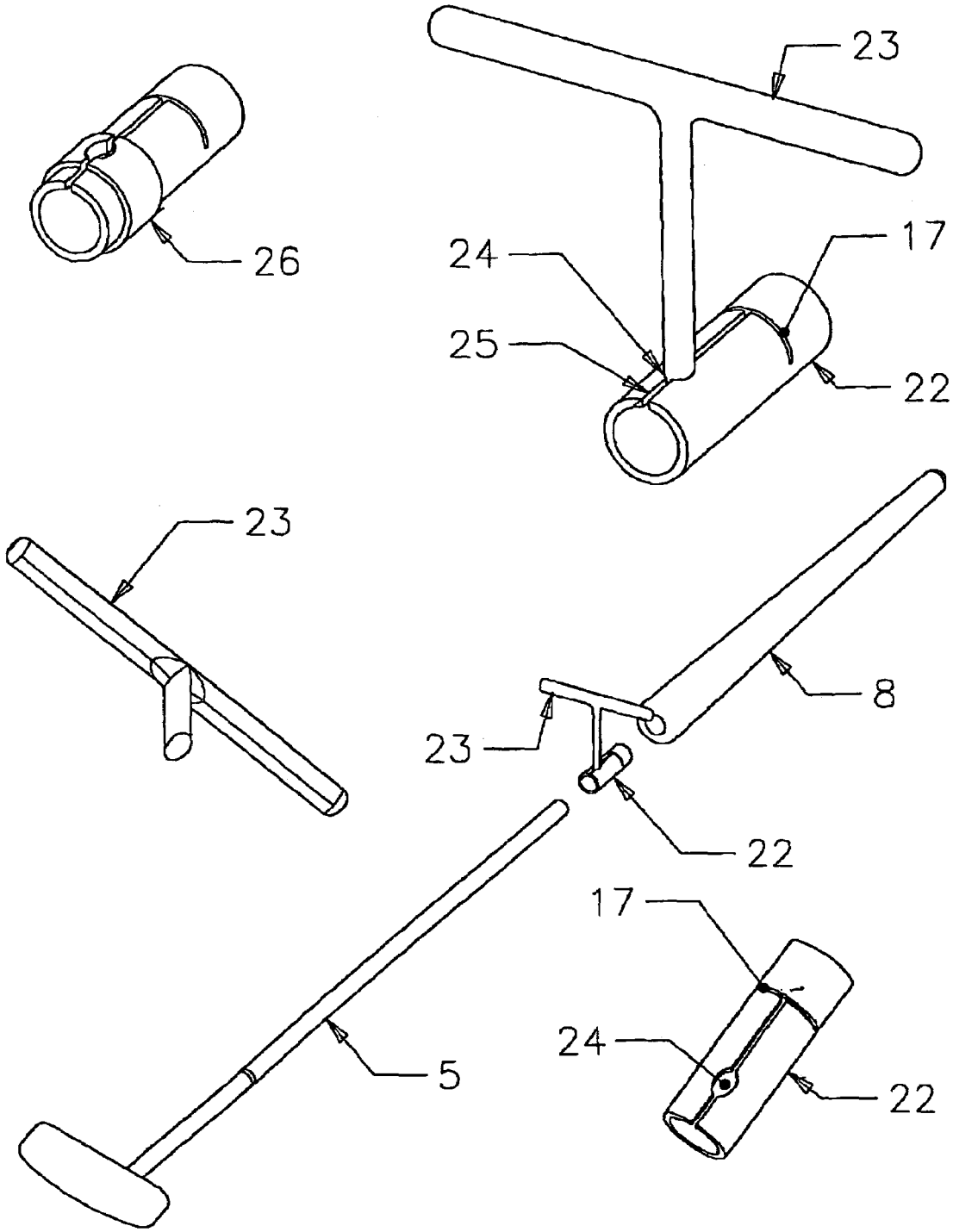

FIG. 12 shows a self locking split shaft mechanism in two variations, with adjusting tools.

Figure 13:
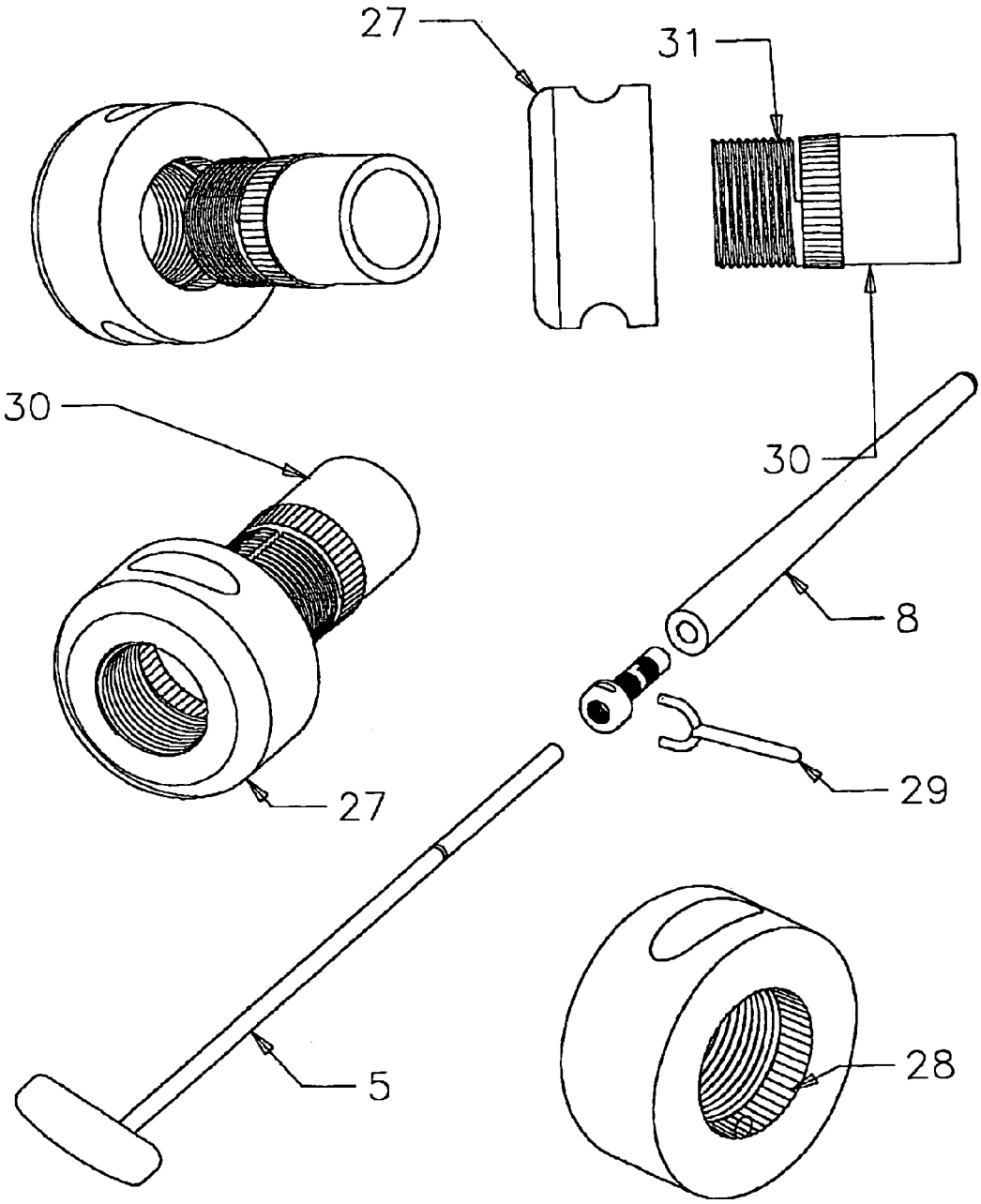

FIG. 13 is a self locking threaded fitting with fictional internal ribs, with adjusting tool.

Figure 14:
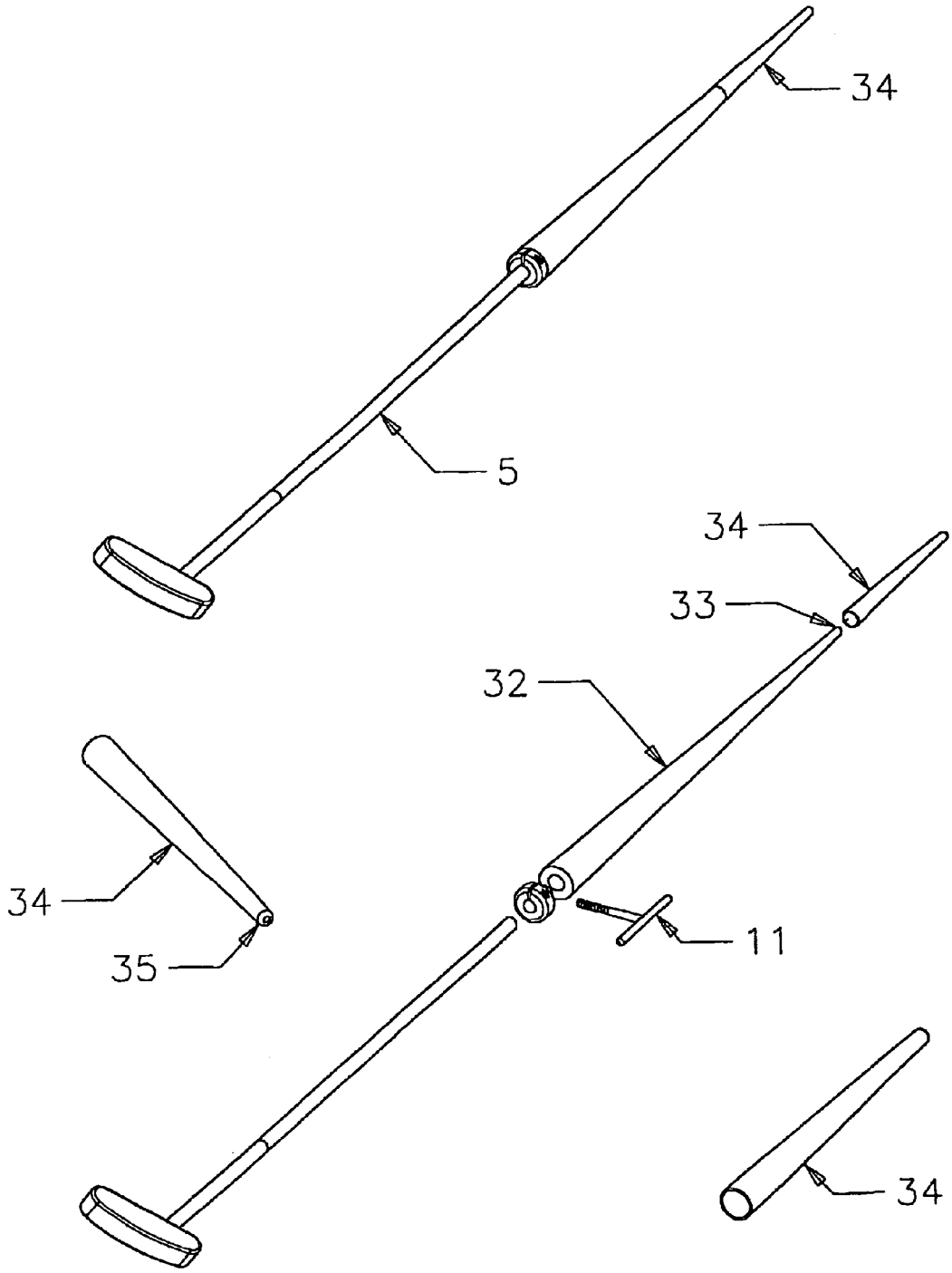

FIG. 14 shows the end cap detail of a reverse taper self locking adjustable length putter.

DETAILED DESCRIPTION OF THE INVENTION

This invention describes an adjustable length putter 10, which is legal for play, with one or two grips (FIGS. 9*a/b*), which may be re-positioned up and down the shaft 5, in a variety of positions (FIG. 10), and secured in place to suit the golfer's stature and preferred posture.

There may be the one grip 8, of any length, which is on the shaft 5 underneath it to support it, or there may be a lower grip 13 and an upper grip 14, which are both on a second outer or upper shaft 15.

Alternatively the lower grip 13 may be on the shaft 5 which connects to the putter head 3, but the upper grip 14 is on the upper shaft 15.

The two key features of this invention are that the putter length is self locked by default, and the adjustment can not be made without a tool 11.

A self locking fixing mechanism is defined as a mechanism which, by default, locks or fixes the components of the putter 10 relative to each other, and is secure enough so that it requires a tool to loosen the components, and thereby adjust the length of the putter.

There are three components to the putter 10, the putter-head 3, the shaft 5, and the grip 8, and this invention relates to adjustment of the relative positions of the shaft and grip.

The grip 8 may be either a structurally rigid unit of itself, (perhaps 'plastics' and or metals), or merely supported by a rigid internal member such as a golf shaft. In this case there would be an inner (lower) shaft and an outer (upper) shaft, with an internal diameter which is greater than the outer diameter of the inner shaft.

This would allow the length of the putter to be adjusted by these two telescoping shafts, with the outer shaft being secured to the inner shaft.

Alternatively where the grip 8 is a structural rigid unit itself, this grip may be secured in position on the shaft 5 directly.

In the detailed description that follows three self locking mechanisms are described. These are a split-collet 12 (FIG. 11), a split-tube 22 (FIG. 12), and a threaded collet 27 with a plurality of frictional internal ribs 28 (FIG. 13).

The self locking split-collet 12 (FIG. 11) is a device which has an internal diameter 16 smaller than an outer diameter 18 of the shaft 5 it is designed to lock on. This difference in diameter is typically in the range of 0.05 mm. to 0.5 mm.

There is a slot 17, which allows the self locking split-collet 12 to be varied in the internal diameter 16 at the larger external diameter end 18 of the collet, but to have a constant internal diameter 19 at a smaller external diameter end 20 of the collet.

By rotating the threaded tool 11 into a threaded hole 21 the golfer can loosen the split-collet 12 and attached grip 8 to alter the length of the putter 10(FIG. 10).

The grip 8 is attached to the smaller external diameter end 20 of the collet 12, and to allow free movement of the grip over the shaft 5, the constant internal diameter 19 is greater than the shaft 5.

A variation of the split-collet could use a tapering-collet much like that which holds a router bit in an electric woodworking router.

A second mechanism which is self locking is a split-tube 22. This mechanism (FIG. 12) is similar to the split-collet (FIG. 11), but is slender in character and tends to operate on the shaft 5 with less force but over a longer distance.

Being slender, the self locking split-tube 22 allows a standard putter grip to be used, and lends itself well to being designed as a product sold for regular putters, either to have them configured as an adjustable belly putter or more likely as an adjustable short putter.

The split-tube itself may be a modified drawn or extruded tube, or similar, or a cast, injection moulded, or machined component.

The tool to adjust the putter 10 could utilise a thread as in the split-collet 12, but a simple design is the use of a tool 23 which is oval in cross section. The tool 23 fits neatly into a similarly oval cross section hole 24 in a lower slot 25 of the split-tube 22. When the tool 23 is used it is rotated through up to 90 degrees to open up the slot 25 and loosen the split-tube's grip on the shaft 5.

An alternative tool would not need there to be the oval hole 24 in the slot 25 but could separate the slot by two parts of the tool moving apart, after having been inserted in the slot.

To provide sufficient surface area for these tools to work on the split-tube 22 it may be advantageous for there to be a localised thickening section 26 in the split-tube mechanism.

A further variation of the split-tube mechanism could be used to alter the length of the shaft itself 5. In this example the shaft 5 would be made up of a pair of telescoping shafts, the upper with one or two grips on it, and the mechanism would serve to lock the two shafts in position, rather than to lock a grip in position. This mechanism would also be self locking to meet the requirements of the Rules of Golf.

A third mechanism (FIG. 13) which is self locking is a threaded collet 27 with a plurality of frictional internal ribs 28. There is a corresponding plurality of external frictional ribs 31 on an outside of an inner tool 30.

Initially the collet 27 can be turned by hand, but before the inner tool 30 locks onto the shaft 5 it is necessary to use a tool 29 to apply leverage so the collet is able to continue turning and decrease the internal diameter of the inner tool 30.

The method of securing either the rigid grip 8, or the outer (upper) shaft 15, to the inner (lower) shaft 5 may involve a mechanical device which reduces the internal diameter of either the rigid grip (over some or all of its length), or of the outer shaft, (over some of all of its length), so that a friction fit occurs to the inner shaft.

A preferred embodiment is an adjustable length putter 36 with a reverse taper single grip 32. The applicant for this patent holds U.S. Pat. No. 6,213,891, which claims the reverse taper putter grip 32 over 350 mm in length (FIG. 14). The reverse taper grip 32 is slender at the top in the area where it engages with a belly button 33, and this grip would therefore fit comfortably into the navel, or belly button. However with its smaller cross section the reverse taper grip 32 is prone to damage at this slender end. To strengthen the grip 32 at this slender end it is advantageous if the end of the grip were made more durable, and supported by an outer durable end cap 34. This end cap 34 would be made of metal or another rigid material, and may have a drainage hole 35 in a smaller end. The end cap 34 may be a simple taper as shown or parallel along its length. This end cap 34 will typically be from 10 to 200 mm in length.

Where two grips are used (FIG. 9*b*), it is preferable that the upper grip 14 is slender in cross section, and the use of the end cap 34 would strengthen this end.

Whilst continuous length adjustment is practical with the abovementioned mechanisms, it may be advantageous to use a step wise variation using perhaps a method commonly found in telescopic walking sticks or telescopic tent poles. A domed button (not shown), which operates radially outwards, near the top of the shaft 5, engages one of a sequence of holes which run length wise within the structure of the grip 8 (also not shown). Step wise adjustment may be preferred by golfers as one can easily try various lengths and go back to former lengths to compare.

The method of securing the telescoping elements may alternatively involve the action of an Allen key or similar tool which acts one or more grub screws or other fixing devices which effectively reduce the diameter of the outer shaft 15 or an attached or integral fixing device, thereby causing a friction fit to occur on the inner shaft.

An essential feature of the aforementioned mechanisms is that there are two shall components, or a shaft component and a grip component, which are telescoping, and substantially parallel to each other, in the area where they telescope.

Figure 1:
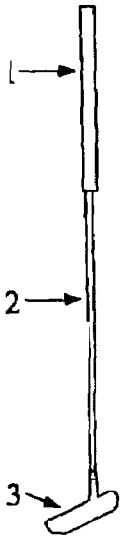
FIG. 1 is a conventional short putter with a short grip.
Figure 3:
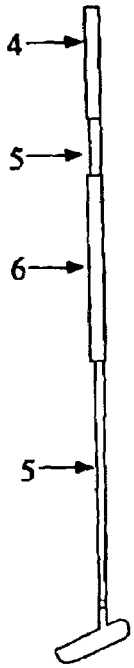
FIG. 3 is a long putter as currently available, with two spaced short grips.
Figure 5:
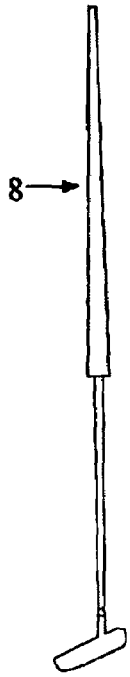
FIG. 5 is a long putter with a single long grip, which tapers so that the cross section of the grip is greater towards the putter-head end.
Figure 6:
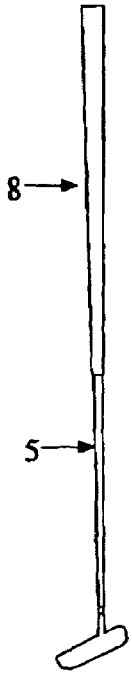
FIG. 6 is a long putter with a single long grip, which tapers so that the cross section of the grip is greater towards the belly button end, when in use.
Figure 7:
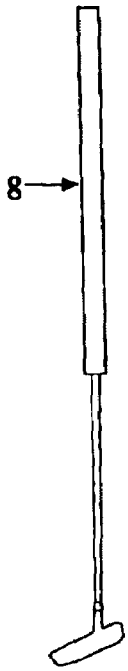
FIG. 7 is a long putter with a single long grip, which has no taper.
Figure 2:
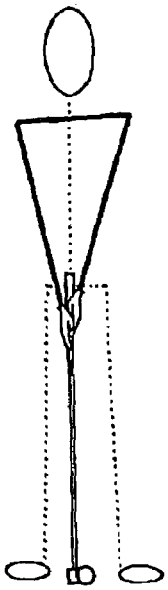
FIG. 2 shows the method of using a conventional short putter, grasping the single grip with both hands.
Figure 4:
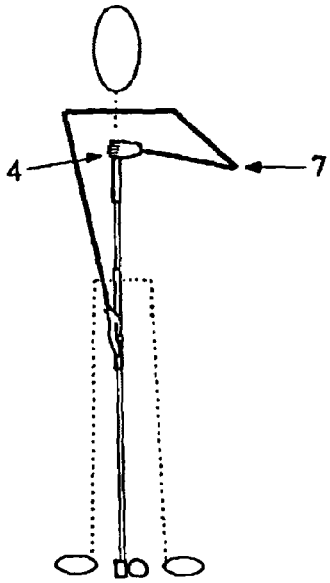
FIG. 4 shows the method of using a long putter as currently available.
Figure 8:
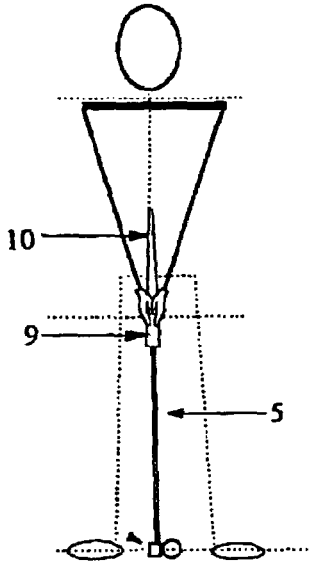
FIG. 8 shows the method of using a belly putter.

The fixing mechanism may be at either end of the lower grip 6 (FIGS. 3 and 9*b*) in the case of a two grip putter, and the putter may vary in the distance from the lower grip 6 and the putter head 3. Alternatively the distance between the lower grip 6 and the upper grip 4 may be varied, or indeed both distances may be variable within one putter.

Any of the mechanist may be designed to be used on regular putters which are commonly parallel in the upper 25 cm. The internal diameter of the mechanism will need to be slightly smaller than the shaft it is to clamp onto.

Aspects of this present invention have been described by way of example only and it should be appreciated that modifications and additions may be made without departing from the scope thereof.

I claim:

1. An adjustable length golf putter, comprising:

at least one shaft;

at least one grip attached to said at least one shaft;

a self-locking mechanism associated with said putter for lengthwise adjustment of said at least one shaft relative to said at least one grip, said mechanism configured for accommodating an adjustment tool, and being locked by default so that the tool must be engaged in said mechanism for said lengthwise adjustment.

2. The golf putter of claim 1 wherein said at least one grip includes a lower grip and an upper grip.

3. The golf putter of claim 1 wherein said at least one shaft includes a first shaft and a second shaft.

4. The golf putter of claim 5 wherein said lower grip is attached onto said first shaft and said upper grip is attached onto said second shaft.

5. The golf putter of claim 1 wherein said lengthwise adjustment of said putter is adjusted in a step wise manner.

6. The golf putter of claim 1 wherein said lengthwise adjustment of said putter is adjusted in a continuous manner.

7. The golf putter of claim 1 wherein said self-locking mechanism is a self-locking collet mechanism.

8. The golf putter of claim 7 wherein said self-locking collet includes a varying internal diameter, a varying external diameter, a slot configured for varying said varying internal and external diameters, a constant internal diameter and an external diameter.

9. The golf putter of claim 8 wherein said varying external diameter includes a threaded opening configured for receiving the tool.

10. A golf putter as in claim 1 with a self-locking tube mechanism.

11. The golf putter of claim 5 wherein said first and second shafts are telescoping and substantially parallel to each other in the area where they telescope.

12. The golf putter of claim 1 wherein said at least one grip and said at least one shaft are telescoping and substantially parallel to each other in the area where they telescope.

13. The golf putter of claim 1 further including an outer rigid end cap attached to said at least one grip.

14. The golf putter of claim 1 wherein said at least one grip is a reverse taper grip including a durable end cap.

15. A golf putter having an adjustable length, comprising:

a shaft having a putter head located at one end thereof;

a self-locking collet connecting an other end of said shaft and said grip;

an end cap attached to said grip; and a tool configured for engaging said collet and adjusting the length of the putter, the length of the putter adjustable only when said tool is engaged with said collet.

16. A golf putter having an adjustable length, comprising:

a pair of telescoping shafts including an outer shaft and an inner shaft;

at least one grip associated with at least one of said pair of telescoping shafts;

a self-locking mechanism configured for securing said outer shaft to said inner shaft; and a tool configured for engaging said self-locking mechanism and allowing said outer shaft to move relative to said inner shaft, adjusting the length of said putter;

wherein a length of said putter is only adjustable when said tool is engaged with said self-locking mechanism.

* * * * *

UNITED STATES PATENT AND TRADEMARK OFFICE

CERTIFICATE OF CORRECTION

PATENT NO. : 7,074,135 B2
APPLICATION NO. : 10/484126
DATED : July 11, 2006
INVENTOR(S) : Simon Garry Moore It is certified that error appears in the above-identified patent and that said Letters Patent is hereby corrected as shown below:

Column 6, line 24, after "shaft", please insert --5-- therefor.

Column 6, line 57, after "putter of", please delete "claim 5", and insert --claim 3-- therefor.

Column 7, line 9, after "putter of", please delete "claim 5", and insert --claim 3-- therefor.

Signed and Sealed this

Second Day of October, 2007

JON W. DUDAS
*Director of the United States Patent and Trademark Office*